United States Patent [19]

Bechtel

[11] Patent Number: 4,905,396

[45] Date of Patent: Mar. 6, 1990

[54] METHOD AND APPARATUS FOR MOUNTING AN AUXILIARY SIGHTING AID ON A FIREARM

[76] Inventor: Daniel L. Bechtel, P.O. Box 11281, Forth Worth, Tex. 76109

[21] Appl. No.: 295,976

[22] Filed: Jan. 11, 1989

[51] Int. Cl.[4] ..... F41G 1/38

[52] U.S. Cl. ..... 42/100; 42/101; 42/103; 33/233; 33/245

[58] Field of Search ..... 42/101, 103, 100; 33/245, 250, 233

[56] References Cited

U.S. PATENT DOCUMENTS

| | | | |
|---|---|---|---|
| 2,924,881 | 2/1960 | Gee | 42/101 |
| 3,483,623 | 12/1969 | Kruzell | 42/101 |
| 3,568,324 | 3/1971 | Jorczak | 42/100 |
| 4,205,473 | 6/1980 | Wilson | 42/101 |
| 4,341,022 | 7/1982 | Santoro | 42/101 |

FOREIGN PATENT DOCUMENTS

| | | | |
|---|---|---|---|
| 723468 | 8/1942 | Fed. Rep. of Germany | 42/101 |
| 2445230 | 4/1976 | Fed. Rep. of Germany | 33/250 |
| 735414 | 8/1955 | United Kingdom | 42/101 |

*Primary Examiner*—Deborah L. Kyle
*Assistant Examiner*—Michael J. Carone
*Attorney, Agent, or Firm*—Charles W. McHugh

[57] ABSTRACT

An apparatus including a rigid base having a first portion, typically the top, that is configured to receive and support an auxiliary sighting aid for a firearm (e.g., a rifle, shotgun or pistol). A typical configuration may be a standard dovetail shape that is sized to receive scope rings of the Weaver type. The firearm must have an accessible aperture, but it need not be integral with the firearm's original structure; an adaptor can be attached to the firearm's original structure so as to create a structural extension which contains the necessary aperture. The rigid base also has an exterior that fosters the correct orientation of the auxiliary sighting aid with respect to the firearm's longitudinal bore. A post having a generally smooth exterior is carried by the base and extends outwardly therefrom for a distance which is sufficient so that the distal end of the post may be inserted into the aperture on the firearm. A hook is provided at the distal end of the post so that it may be pushed under a portion of the lip surrounding the aperture. By pulling upward on a properly placed hook, it can be caused to bear tightly against the lower surface of the lip in order to rigidly secure the post (and the rigid base) to the firearm. One way of causing the post to rise or descent in a smooth bore in the base is to provide threads in the top of the post, and then provide a threaded nut for engaging the post. Ideally, a permanently-captured, threaded nut is located near the top of the base, so that it is readily engageable by the digits of one hand—which may be the same hand that is holding (e.g. cradling) the auxiliary sighting aid. This permits one-handed installation or removal of a scope or the like on a firearm.

23 Claims, 2 Drawing Sheets

METHOD AND APPARATUS FOR MOUNTING AN AUXILIARY SIGHTING AID ON A FIREARM

BACKGROUND OF THE INVENTION

It is well known to supplement or replace the orginal iron sights on a firearm such as a rifle, shotgun or pistol with auxiliary sighting aids. Such aids include optical scopes, so-called "night vision" devices, and electronic devices designed to amplify whatever ambient light may be present in the field of view. One way to categorize such auxiliary sighting aids is according to whether they are intended to be permanently mounted on a firearm, or whether they are adapted to be selectively installed and removed from the firearm—to meet certain needs. For example, if a rifle is to be carried by a paratrooper who is jumping from an airplane, it will likely be useful to protect an optical scope from possible damage as the paratrooper hits the ground with a rifle slung on his shoulder. It would be desirable in such a situation to have the scope safely stored away in a cushioned place in a backpack or the like, so that the paratrooper could retrieve the scope and quickly affix it to his rifle once he has disengaged himself from the parachute harness. In preparation for another jump the scope would, of course, have to be again removed from the rifle and stored in a place where it is not as vulnerable as it would be if it were permanently mounted on top of a rifle.

Other situations make it either convenient or necessary that an auxiliary sighting aid be at least temporarily removed from a firearm. For example, a night vision device may need to be sent to a service center for inspection and, if necessary, adjustment, repair or calibration. But there is no need to have an operative rifle in the same service facility where work is being done on the night vision device, so the ability to achieve a quick and easy separation of the two items is desirable. The rifle can then be securely maintained in an armory or the like while work is being done on the night vision device at a remote site.

Besides conventional sighting aids such as those illustrated in U.S. Pat. No. 4,341,022 to Santoro entitled "Detachable Zero-Set Scope Mount for Handguns and Other Firearms" and U.S. Pat. No. 4,742,636 to Swan entitled "Mount for Mounting an Optical Sight on a Firearm," there are other auxiliary sighting aids in the form of flashlights which are sometimes attached to shotguns and the like for illuminating a target at nighttime. A user of such a scope can be a farmer trying to protect a chicken coop from an invading varmint, a policeman accomplishing a nighttime raid on a building where illicit drugs are being sold, or a hunter who is trying to bring home his quota of nocturnal animals. Naturally, it would be advantageous to be able to use a flashlight in a conventional manner until such time as the need arose to use a firearm. And it would be preferable to be able to point the flashlight alone—without the need to simultaneously point a firearm where a user wants to see something. But when the time comes to combine the flashlight with a firearm, it would be advisable for the beam of light that is produced by the flashlight to be dependably aligned with the bore of the firearm. Hence, an essentially fail-safe technique for installing a flashlight on a firearm can be critical to the success of a shot that is fired into an otherwise dark environment.

Apart from categorizing mounts for auxiliary sighting aids according to whether they are primarily adapted for permanent or on/off mounting, the on/off (or detachable) variety could further be classified as to whether they would meet the harsh requirements of functioning as a military-type mounting system. For example, the aforementioned Santoro scope mount for handguns may be perfectly suited for use by persons who periodically go to a recreational gun range and shoot at paper targets or the like. That is, both the pistols and scopes that are used by target shooters are typically kept in sturdy protective boxes and maintained in a clean condition. And when the conditions of field use do not involve subjecting the separated parts of a mounting system to mud, dirt, sand or ice, such systems may work perfectly well. On the other hand, the field conditions routinely experienced by military personnel and some hunters would render many civilian mounting systems completely useless. As a practical matter, then, any so-called "detachable" scope-mounting system which is intended for use by military personnel or by others whose firearms are subjected to harsh weather conditions must be less vulnerable to adverse environmental conditions.

One way that others have attempted to make military mounts less vulnerable to mud and the like is to avoid the kind of threaded engagement that is shown by Santoro. The Swan construction is one such alternative construction; and while Swan still employs two cooperatively-threaded elements, at least his threaded elements are not fixed to a firearm where they are subject to becoming fouled. Instead, Swan uses a threaded bolt that protrudes downwardly from a movable base, and the bolt extends through a smooth aperture where the bolt is engaged by a removable nut. Because both the bolt and the nut can be kept out of the mud by storing them in a protective bag when they are not installed on a rifle, a mounting system like that shown by Swan does offer at least some improvement over designs that have a threaded member permanently connected to a firearm. Unfortunately, though, the Swan construction solves one problem by introducing another. Specifically, the presence of a removable nut to hold a base on a rifle means that the nut can be dropped into a contaminating material (like mud or snow), or misplaced, or even lost. An ideal mount would avoid the risk of having a threaded member become fouled as a result of having it permanently attached to a firearm, while also having all parts of the mount connected together in such a way that there are no loose parts that can become separated or lost.

Accordingly, it is an object of this invention to provide a mounting system having easy-on/easy-off characteristics and features that render it essentially immune to harsh environmental conditions.

Another object is to provide a mount for an auxiliary sighting aid in which there are no separable parts—like a fastening nut—that can become separated from the mount assembly, so that the mount will not be vulnerable to being rendered inoperative just because a fastening nut has been lost or misplaced.

A further object is to provide a mounting system for an auxiliary sighting aid which can be affixed to a firearm in the field using only a single hand, so that a user's other hand might be left free for holding equipment or grasping something like a rappeling rope.

These and other objects will be apparent from a reading of the specification and the claims appended thereto, as well as reference to the several figures of the drawing provided herewith.

BRIEF DESCRIPTION OF THE INVENTION

Figure 1:
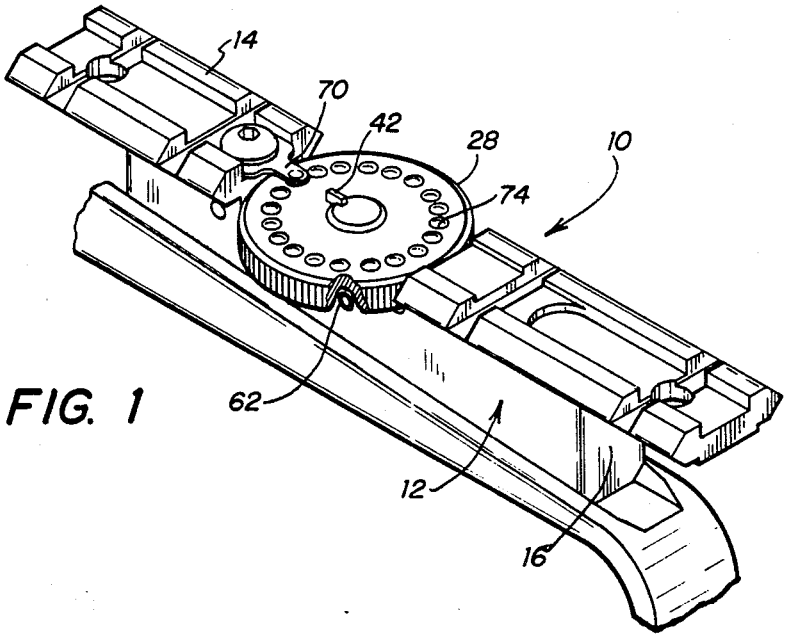
FIG. 1 is a perspective view of a mounting apparatus for receiving and holding an auxiliary sighting device on a rifle that is configured like the U.S. Army M16 family of rifles.

In brief, an apparatus in accordance with this invention includes a rigid base which has a first portion, typically the top, that is configured to receive and support an auxiliary sighting aid for a firearm. A typical configuration may be a standard dovetail shape that is sized to receive scope rings of the Weaver type. The firearm to which the base is attached need not be of a particular type or style, even though some firearms are more readily adapted to employ this apparatus than are others. For example, the M16 rifle which has been adopted and widely used by many military and police forces throughout the world already has an aperture in an integral part of the rifle's structure, namely, its handle. It is this aperture which makes the M16 family of rifles particularly suitable for being engaged by an apparatus in accordance with this invention.

The firearm, whether it is a rifle, pistol or shotgun, need not have an integral aperture in some sturdy structural member in order to accept and support an auxiliary sighting aid. It is possible to provide an adaptor which can be attached to the firearm's original structure so as to create an extension of that structure. For example, the necessary aperture for receiving a mounting apparatus may be provided on the top or side of an add-on bracket like that shown in U.S. Pat. No. 3,834,052 to Steck entitled "Mount for Gunsight." A variety of brackets similar to the Steck mount are commercially available from sources such as B-Square Company in Fort Worth, Tex..

The auxiliary sighting aid which can be attached to a firearm may be any device that will assist a user in aiming at a target. That is, the sighting aid may be a conventional optical scope, or it may be a sophisticated electronic device that is designed to absorb as much ambient light as is available—and then amplify that light through electronics to produce an enhanced image for the shooter. Alternatively, the sighting aid may be a light source such as a laser or even a conventional flashlight which a hunter wishes to attach to a shotgun in order to improve his ability to see a target at nighttime. Of course, other sighting aids may be developed in the future, so it should be understood that the invention described herein is concerned primarily with the concept of the mounting system disclosed herein—and not with any particular auxiliary sighting aid.

A necessary part of the apparatus includes some means for orienting the rigid base with respect to the firearm so that any auxiliary sighting aid that is attached to the base will be generally aligned with the firearm's longitudinal bore. Such an orienting means is necessary because the main thrust of this invention is concerned with fastening a sighting aid to a firearm, and it is only indirectly concerned with the precise alignment of that sighting aid per se. Expressed in other words, it would likely be of minimal value to the user to be able to quickly attach a sighting aid if the sighting aid were erratically oriented with respect to the firearm's bore. So, some dependable orienting means must be employed in conjunction with the novel fastening apparatus described herein. Exemplary orienting means include shoulders that abut a known reference surface on a firearm, and non-circular apertures that can only accomodate a base with a single orientation, etc.

A post having a generally smooth exterior is carried by the base and extends outwardly from the base for a distance which is sufficient so that the distal end of the post may be inserted into the aperture on the firearm. Also provided is some means for manually securing the post in the aperture in such a way that the base will be rigidly fixed to the firearm when the post is secured. The preferred manner of securing the post in the aperture involves a hook that is provided at the distal end of the post, said hook having a configuration such that it may be pushed under a portion of the lip surrounding the aperture. By then pulling upward on a properly placed hook, a transverse portion of the hook can be caused to bear tightly against the lower surface of the lip in order to rigidly secure the hook (and its associated post) to the firearm.

One way of achieving this tight engagement between the hook and a structural part of the firearm is by providing threads on the top of the post which are engaged by a threaded nut or the like (above the base). By rotating the nut, preferably with only the fingers of a person's hand, the post may be caused to rise or descend in a smooth bore in the base. Ideally, the threaded nut is in the form of a knurled knob that is located near the top of the base so that it is readily engageable by the digits of one hand—which may be the same hand that is holding (e.g., cradling) the auxiliary sighting aid and the base. In other words, a person holding a conventional scope in the palm of his hand can simultaneously grasp the knurled knob and rotate the same with his thumb and forefinger; he can thereby achieve or release a connection between the auxiliary sighting aid and the firearm. Thus, an apparatus in accordance with this invention will permit onehanded installation or removal of a scope or the like, so that the user need not have two hands available to either install or remove an auxiliary sighting aid.

DETAILED DESCRIPTION OF THE PREFERRED EMBODIMENT OF THE INVENTION

Referring initially to FIG. 1, an apparatus 10 in accordance with this invention is shown installed on top of the handle of a rifle, the rifle having a configuration like that shown in U.S. Pat. No. 3,742,636. The apparatus includes a rigid base 12 having a first portion 14 that is configured so as to receive and support an auxiliary sighting aid for a firearm. As stated above, the auxiliary sighting aid may be any of several things, including an optical scope, a so-called "night vision" device, an electronic image enhancement device, or a light source such as a laser or flashlight. In the embodidiment shown in FIG. 1, the first portion 14 is configured in the manner of a conventional dovetail mount that is adapted to receive rings of the Weaver type (made popular many years ago by the W. R. Weaver Company of El Paso, Tex.). A dovetail configuration with a width of about 0.85 inch and a thickness of about 0.2 inch is widely used, and many NATO countries are beginning to standardize their scope mounts so as to be compatible with this configuration.

Another portion of the base 12, typically the lower portion 16, is configured in such a way that the base may be dependably and accurately aligned with the firearm's longitudinal bore when the base is physically connected to the firearm. As indicated in FIG. 1, the bottom of the base 12 has an external configuration that is complementary to the generally U-shaped groove in the top of the rigid handle. By designing the base lower portion 16 in this manner, the apparatus 10 may be repeatedly installed on and removed from the firearm without affecting any alignment that has been accomplished through any ancillary steps to "zero" the rifle.

Figure 2:
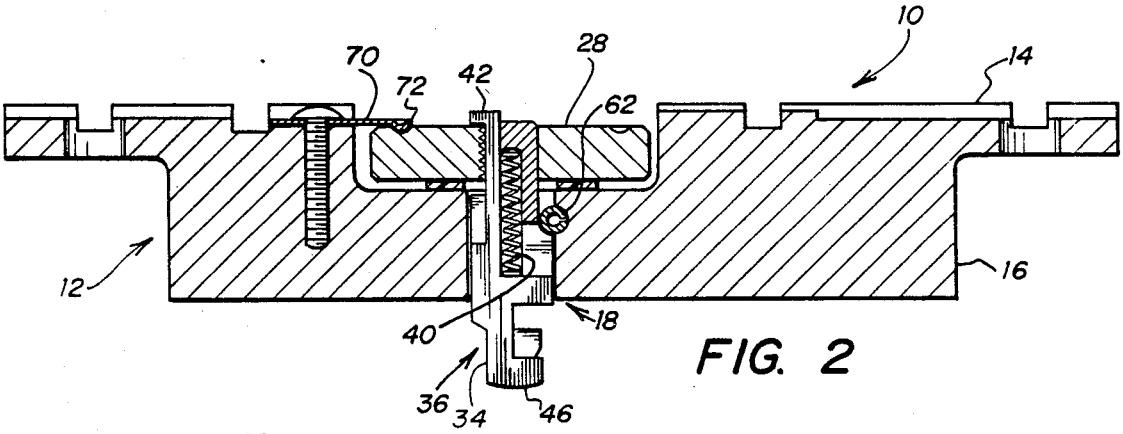
FIG. 2 is a side elevational view, in cross-section, of the mounting apparatus shown in FIG. 1.

Referring next to FIG. 2, which is a side elevational view of the apparatus 10, a post 18 extends outwardly from the base for a distance which permits it to be inserted into an aperture in the bottom of the rifle handle. The nominal size for M16 apertures is about 0.275 inch, and the preferred diameter of the post 18 to engage such apertures will provide what may be called a relatively loose—but not sloppy—fit. For example, the post 18 will preferably have a lower portion with a diameter of about 0.26 inch.

To manually insert a post into an aperture is of little consequence, however, unless a convenient means is provided to secure that post within the aperture so as to rigidly fix the post (and its associated base) to the firearm. The preferred technique for achieving this rigid connection involves providing a hook 20 at the distal end of the post 18, and also providing a means for selectively retracing the hook at the appropriate time. While the hook could constitute an element that is carried by, but is distinct from, the post 18, the preferred technique involves creating the functional hook as an integral part of said post. To accomplish this, the post 18 may be undercut at a point near its distal end in such a way as to leave a residual part of the post—which now may be considered to be a longitudinal element 22 of the hook. The most extreme and outward part of the post may then be considered to be a transverse element 24 of the hook. (This element 24 is referred to as a transverse element because it extends perpendicularly to the longitudinal axis of the post.) The transverse element 24 preferably extends forwardly from the longitudinal element 22 for a distance of about ⅛ inch, which is quite adequate to produce an upper bearing surface which can contact and bear against a lower surface of the lip surrounding the aperture on the firearm's handle.

Having provided a transverse bearing surface on hook 20, there must now be provided some means for selectively retracting the hook (toward the base) after the transverse element 24 has been suitably positioned below the lip. The preferred technique involves providing right-hand external threads 26 on top of the post 18, and providing a relatively large knob 28 with complementary internal threads 30. Rotating the knob 28 clockwise will cause its threads 30 to advance with respect to the post threads 26; but since the knob is structurally prevented from moving downward (by a top portion of the base 12), the knob remains at a fixed elevation and the post is necessarily pulled upward. Assuming that the lip around the aperture has been properly positioned with respect to the hook 20, turning the large knob 28 will soon cause the transverse element 24 to bear tightly against the aperture's lip.

Using gravity would be one way of properly positioning the hook 20 with respect to the aperture. However, relying on gravity is not always an ideal situation, because it necessarily requires that both the firearm and the base be correctly oriented in order to take advantage of a downwardly oriented gravitational force. It is believed more prudent to build in a mechanism which will positively and reliably force the hook forward and under the aperture lip—as soon as the post 18 has been pushed a sufficient distance into (or through) the aperture. To this end, there is provided in the preferred embodiment a blocking element 34 which is associated with the post 18 in order to be carried thereby, and said blocking element having one portion which extends outside of the envelope defined by the lower part of the post. Ideally, the blocking element is spring biased in a downward direction so that it is constantly urged toward the distal end of the post.

Figure 3:
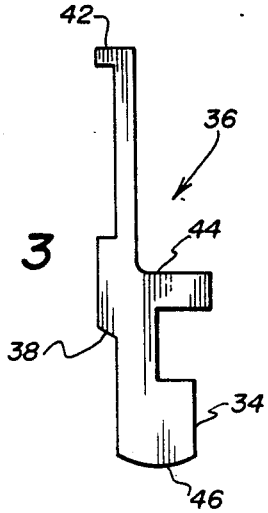
FIG. 3 is a side elevational view of a generally flat key that can serve to keep the post in a desired position with respect to a rifle aperture.
Figure 4:
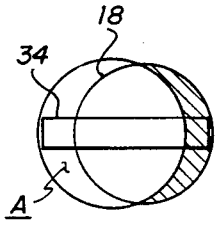
FIG. 4 is a fragmentary bottom plan view of the cooperating post and rifle aperture, said view revealing how the post can be shifted sideways within an aperture to obtain a desired amount of engagement between the post and the lip surrounding the aperture.

Referring next to FIG. 3, the blocking element 34 constitutes the bottom rear portion of the key 36; and it is this portion which is exposed at the rear of the distal end of the post. Immediately above the blocking portion 34 is an inclined ramp 38, preferably having an angle of about 30 degrees with respect to a transverse axis through the key 36. As the post 18 is pushed through the aperture, the ramp 38 will usually bear against the rear edge of the aperture and will usually cause the key 36—and its associated post 18—to move forward within the aperture. The net result of this forward movement of the post 18 is to cause transverse element 24 to move under the aperture lip, regardless of the orientation of the rifle and the base 12. The resulting relative position of the aperture A and the hook 20 and the blocking element 34 is shown in FIG. 4. The area of overlap between the transverse element 24 and the aperture lip is indicated by the shaded region in the figure.

It should be clear that as long as the blocking element 34 extends alongside the hook 20 for a distance that is sufficient to protrude into the firearm's aperture, the hook will be precluded from moving backward to the extent that the hook might be disengaged from the aperture. In other words, the hook 20 cannot be removed from the firearm's aperture as long as the blocking element 34 is in its operative position behind the hook—even though the transverse element 24 is not pressed tightly against the aperture lip. This is particularly advantageous because it provides a safety device to ensure that the auxiliary sighting aid will not fall away from the firearm and become damaged or lost, even if the tension caused by the engaged threads 26, 30 should accidentally become less than necessary for a rigid mounting of the sighting aid. This feature also permits a hasty installation of a sighting aid on a firearm by ensuring that the two items are coupled together just as soon as the post has penetrated a sufficient distance into the aperture. Final solidification of the connection between the sighting aid and the firearm can be subsequently accomplished by rotating the knob 28 enough to withdraw the hook 20 into load-bearing contact with the aperture lip.

Referring again to FIG. 3, the top of the key 36 extends transversely outward to provide an L-shaped member 42 which has a transverse length that is adequate to overlie at least a small portion of the top of the knob 28. By providing this L-shaped top 42, the step of rotating the knob 28 counterclockwise will accomplish two things: first, it will push the post 18 downward, which will relieve the pressure between the hook 20 and the aperture lip. Eventually, of course, the hook 20 will no longer be in contact with the aperture lip; and, if it were not for the presence of the blocking element 34, the post could be retracted from the aperture. But while the post 18 was moving downward with respect to the base 12, the key 36 was precluded from also moving downward, because its top 42 is fixed at the same elevation by virtue of its engagement with a shallow counterbore in the top of the knob 28. Examined from a different perspective, the key 36 will rise with respect to a descending post 18 (as the knob is turned), such that the ramp 38 will eventually become juxtaposed with the top edge of the aperture. The result of this is that a spring 40 (which is under compression) will tend to relieve that compression by moving whatever part is free to move. In terms of mass or weight, the firearm is certainly heavier than the base and its attached sighting aid, so it is usually the base and the sighting aid which are pushed away from the static firearm. The spring 40 is of relatively small size, so it does not have enough potential energy to push a sighting aid and base very far or very fast; but it does help ensure that there is essentially a "clean break" when a sighting aid is being removed from a firearm. A preferred material for the spring 40 is SAE 1095 cold-rolled spring steel wire having a diameter of about 0.012 inch; the wire is ideally blue tempered to produce a steel that is commonly used in clocks and motor springs. The spring 40 will advantageously have a diameter of about 3/32 inch so that it can easily be carried internally of the post 18, and it will normally have an uncompressed length of about ⅝ inch with 16 turns. The top of the spring 40 will bear against the top of a vertical bore in post 18, and the bottom of the spring will bear against a horizontal seat 44 on key 36. When installed, the spring 40 will always be lightly compressed so as to constantly urge the key 36 downward and away from knob 28.

While it is possible to rotate the knob 28 far enough to cause the ramp 38 to begin to act on a top edge of the aperture lip, a preferred technique is to disengage the base 12 more quickly than would normally be achieved by rotating the knob through whatever revolutions it might take to achieve separation. By making the key 36 long enough so that its bottom 46 extends below the distal end of the post 18, it is possible to take a finger and push upward on the bottom 46 with a modest force until ramp 38 clears the top edge of the aperture. The base 12 will then be urged away from the firearm by the spring 40. It should be understood, however, that pushing upward on the key bottom 46 will have no effect on a tightly mounted base 12. So as long as the knob 28 has been rotated clockwise enough to secure the hook 20 tightly to the confronting lip of the aperture, no amount of pushing on the key 36 will have any effect on the mounted base. It is only when the hook and aperture are very loosely connected that pushing upward on the key will cause a quick release of the base. It will be understood, of course, that terms used herein like upward and downward are relative and not absolute terms; they refer primarily to the drawing.

Figure 5:
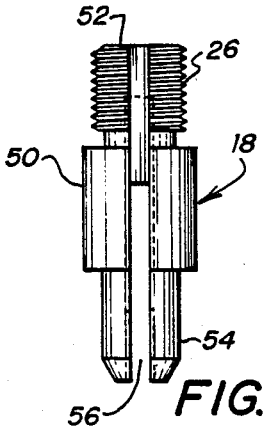
FIG. 5 is rear elevational view of a machined post that is serviceable with the invention.

Turning attention now to specific details of the post 18, and referring next to FIG. 5, the preferred embodiment of a post 18 comprises a generally elongated and cylindrical steel body 50 having a top 52 and a bottom 54. The length of the body 50 is designed so that the bottom 54 will protrude below the firearm aperture when the apparatus 10 is installed on a firearm. A length of about one inch will usually suffice for posts that are intended to engage M16 apertures. In another part of this disclosure, the bottom 54 is referred to as the distal end of the post 18, because it is the top 52 that is threadably secured to the base 12.

Figure 6:
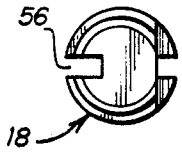
FIG. 6 is a top plan view of the post shown in FIG. 5, and showing a shallow portion of the groove that slideably receives the key of FIG. 3.

FIG. 5 is a rear elevational view of the post 18, and shows a longitudinal slot 56 which is sized to accommodate at least a portion of the blocking element 34. Near the top of the post 18 the slot 56 is relatively shallow, because it need only accommodate the narrow top portion of key 36. Near the bottom of the body 50, the slot 56 extends all the way across the body, such that the post may be described as being bifurcated at its distal end. This configuration permits the relatively wide bottom 46 of key 36 to be fully accommodated by the post 18. The difference between the slot width along the length of body 50 will be readily apparent by comparing the top view of the post in FIG. 6 and the bottom view in FIG. 7.

Figure 8:
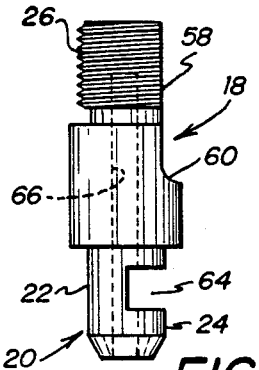
FIG. 8 is a side elevational view of the post shown in FIG. 5.

Referring now to FIG. 8, which is a side view of the post 18, a right-hand portion of the body 50 adjacent the top 52 has been machined away to provide a generally flat face 58. The purpose of this relieved portion is to create a shoulder 60 at the bottom of face 58, said shoulder providing a structural feature which can cooperate with a locking pin 62 in the base 12—for controlling the amount of vertical movement that is possible when the post 18 is mounted on the base 12. (The locking pin 62, typically a rolled pin, is visible in FIG. 2.) Also clearly visible in FIG. 8 is the transverse cut near the bottom of the body 50 that produces the functional hook 20 previously described. A cutter having a width of about ⅛ inch can readily produce the slot 64 which leaves a hook-shaped residual portion at the bottom of the post.

Figure 9:
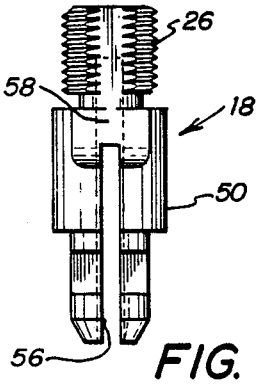
FIG. 9 is a front elevational view of the post shown in FIG. 5.

The front of the post 18 is shown in FIG. 9, which more clearly reveals the two legs at the bottom of the bifurcated post. The flat machined face 58 is also clearly visible in this figure. The top portion of the post 18 contains threads 26 which are typically about 0.3 inch in length, and which are engaged by the internal threads 30 on knob 28.

Figure 7:
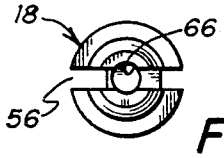
FIG. 7 is a bottom plan view of the post shown in FIG. 5, and showing the wide portion of the slot that receives the bottom of the key of FIG. 3.

Turning again to the bottom view of post 18 in FIG. 7, a longitudinal bore 66 is clearly visible. This bore 66, which extends for about three-quarters of the length of the body 50, has a diameter of about 3/32 inch, and it is this bore which accommodates the coil spring 40 that continuously urges the key 36 downward with respect to the post 18.

Figure 10:
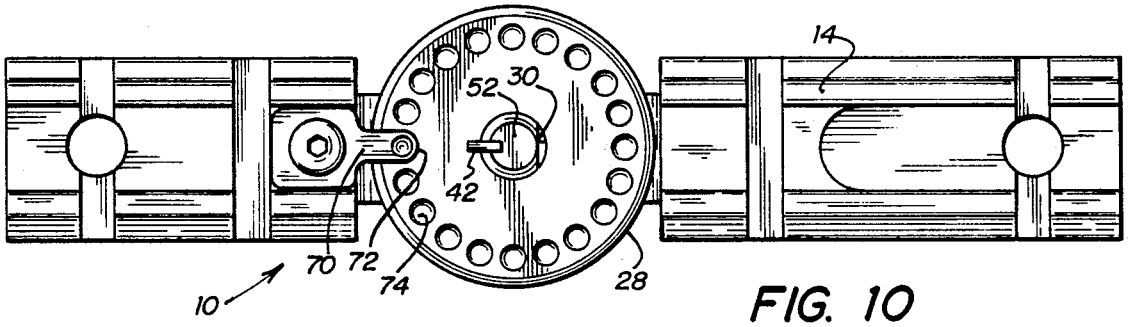
FIG. 10 is a top plan view of the mounting assembly shown in FIG. 1, with the rifle handle being omitted for simplicity.

Referring next to FIG. 10, which is a top view of the apparatus 10, an optional feature of the invention is shown in the form of a biasing element 70—which actually is a small spring steel arm that is mounted on the base 12 and extends in a cantilevered fashion over an edge of the knob 28. The distal end of the biasing element 70, identified by the numeral 72, has a downwardly extending bump which is adapted to fit into any of the dimples 74 in the top of the knob 28. The combination of the biasing element 70 and the dimples or recesses 74 provide a type of biasing effect to ensure that the knob 28 will be physically held at whatever position has been chosen by the user, even when the apparatus 10 is subjected to the kind of shock or vibration that might otherwise tend to loosen a threaded connection between two elements. Perhaps it should be pointed out, however, that the biasing element 70 and its attachment screw constitute only a form of insurance against accidental loosening of the knob 28 when it is subjected to *extremely* rough treatment; and these two pieces are not necessary to the basic operation of the mounting system. Therefore, the mandatory elements in the apparatus described herein actually include only six pieces. A nylon washer between the knob 28 and the top of base 12 is an optional seventh piece. This relatively small number of elements should be even more impressive when it is compared with the large number of elements in other mounting systems that accomplish similar things.

To avoid any possible confusion with regard to some superficial similarities that exist between the system being claimed herein and the mount shown in the Santoro patent, one very important difference should be pointed out. Those who are familiar with the realities of warfare will immediately recognize the inherent limitations of a Santoro mounting system. The limitations arise from the fact that the externally threaded post on a Santoro system must engage internal threads on the firearm; and internal threads are notoriously susceptible to becoming fouled with mud, sand, ice, hardened grease, and other contaminants that could make it difficult or impossible to engage an externally threaded post. The present invention, on the other hand, involves only the use of a hook which is rigidly connected to a lip around some aperture on a firearm's structure. And with this invention even an aperture that has become blocked with mud or the like could be easily and quickly cleared with something as simple and as handy as the pointed end of a bullet. So even a firearm whose exterior is extremely dirty could receive and rigidly mount an auxiliary sighting aid using the apparatus disclosed herein.

Figure 11:
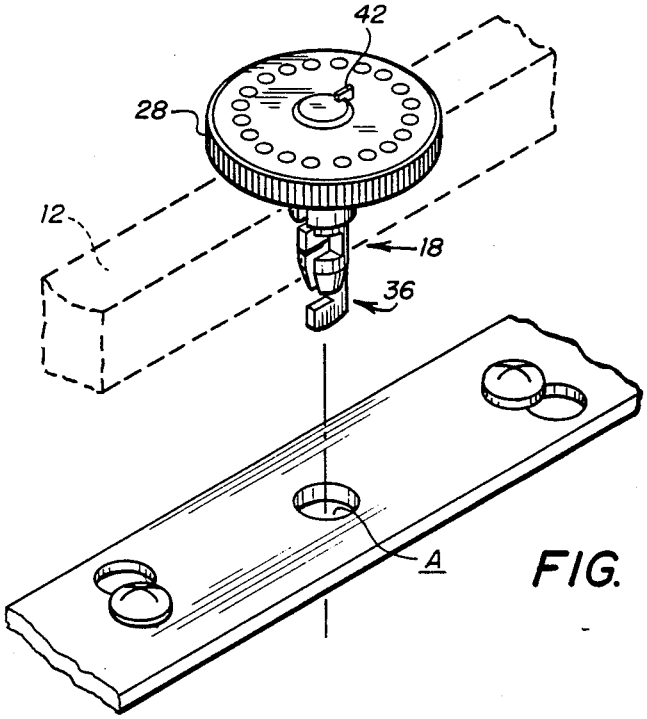
FIG. 11 is a partially exploded, perspective view of a major part of the mounting system disclosed herein, wherein an adaptor plate is provided for direct attachment to a firearm—and a suitably configured post is attachable to the adaptor plate.

The method of using an apparatus as described herein involves initially examining the firearm to which the sighting aid is to be attached and finding some suitable structure which either already has an aperture or which can be provided with an aperture. The size of the aperture will, of course, be influenced by the size of the post that is to mate with the aperture. To achieve adequate strength in the post—that will serve as the primary load-carrying element of the apparatus, an aperture having a size of about 5/16 inch will often be desirable. If the aperture is round, a decision must then be made about how the sighting aid will be correctly oriented once the base has been secured to the firearm. Those skilled in the art will recognize that there probably are a variety of ways in which correct alignment can be assured. For example, the base may have an external configuration which causes it to be immediately and dependably aligned when a shoulder or lip makes contact with some surface on the firearm that can function as a reference plane. Or, the aperture that is provided on some adaptor plate or the like may have a non-circular shape so that the base can only be mounted with a single orientation. Exemplary non-round shapes include pentagons and half-round apertures. An example of an adaptor plate is illustrated in FIG. 11.

Of course, there must be a recess or small amount of clearance below the aperture, so that a hook or its equivalent at the distal end of a post can fit under a lip surrounding the aperture. If a user wishes to take advantage of the manual "quick release" feature of the invention, then there must be enough space to permit the user's finger or some lever or the like to engage a quick-release element. But if the user can tolerate the time which is required to rotate a knob for couple of revolutions, then disengagement can be achieved entirely from the top of the base, and only a relatively small recess need be provided below the aperture.

A rigid post with a generally smooth exterior is then provided on the base in such a way that it protrudes outwardly for a distance that is sufficient to extend through the firearm's aperture. By use of the expression "smooth exterior" it is intended to distinguish over threaded bolts of the kind taught by Swan in U.S. Pat. No. 4,742,636. But the exterior of the post need not necessarily be round. Indeed, if the aperture on the firearm is not round, then the external configuration of the post will naturally be selected to fit snugly within whatever shape the aperture has.

Once the post has been inserted into the aperture, it is then necessary to achieve a locked condition of the post with respect to the structure around the aperture. The preferred way of accomplishing this is to provide a hook at the distal end of the post and slide the hook sideways (under the aperture's lip) until the hook is in position to bear tightly against the lip when the hook is raised. By providing a hook which is an integral part of the post and hence is not rotatable, moving the post sideways will automatically move the hook sideways. Inserting a blocking element behind the post after it has been moved to a potentially locked position will ensure that the post cannot be inadvertently retracted from the aperture until such time as the blocking element has been released.

With the post and its associated hook in the correct position with respect to the aperture, all that remains is to pull upward on the post until a horizontal surface on the hook bears firmly against the bottom of the lip. This may be accomplished with a cam, a ramp, a wedge, or—preferably—relative movement between two threaded members. By providing external threads on the top of the post, and an internally threaded knob which is captured on top of the base, the post may be caused to rise or descend in a smooth bore in the base by rotating the knob. And by making the post long enough so that such a knob will be positioned very close to an auxiliary sighting aid on top of the base, the user may be able to cradle the sighting aid in the palm of his hand and still be able to reach the knob so as to rotate it. It will be possible, therefore, to attach or disconnect an auxiliary sighting aid with respect to a firearm without the use of any tools and using only a single hand.

When the base is combined with an auxiliary sighting aid, the combination will typically be relatively compact, and the necessary post need not protrude more than about 5/16 inch from the bottom of the base. Even if a quick release option is included, the total length of protrusion below the base need only be about ⅜ inch. Hence, the sighting aid and an attached base can readily be stored in a compact package. When the sighting aid is to be attached to the firearm, it can be retrieved from a storage location and quickly installed with only a minimal amount of consumed time and hand motion. Perhaps more significantly, the user can withdraw the sighting aid from its storage location and not have to worry about whether the mounting apparatus will still be complete and functional when it is removed from storage. There are no loose parts and there is nothing to be misplaced or lost.

While only the preferred embodiments have been disclosed in great detail herein, it should be apparent to those skilled in the art that modifications thereof could be readily accomplished without departing from the spirit of the invention. Accordingly, this invention should be regarded as limited only by the claims that are appended hereto.

What is claimed is:

1. An apparatus for installing an auxiliary sighting aid such as an optical scope onto a firearm such as a rifle, shotgun or pistol, said firearm having a longitudinal bore and having a structural part with an aperture that extends therethrough, and that portion of the structural part which immediately surrounds the aperture constituting a lip, comprising:

(a) a base having a first portion that is configured to receive and support an auxiliary sighting aid for a firearm;

(b) means for orienting the base with respect to the firearm so that an auxiliary sighting aid which is attached to the base will be generally aligned with the firearm's longitudinal bore;

(c) means for selectively connecting the base to the firearm, including a post extending outwardly from the base and the post having a longitudinal axis and a generally smooth exterior, said post having a size and shape which permits it to be inserted into an aperture on the structural part of the firearm, and the post also having a slot which extends transversely inward from one side of the post, and the slot having a width that is great enough to envelop the lip of the structural part when the post is inserted into the aperture and then moved sideways after the slot has been aligned with the lip; and (d) means for selectively and rigidly securing the post in the aperture, including means for moving the post into physical contact with the structural part after the slot has been aligned with the lip and the post has been moved sideways by a short distance that is sufficient to place a portion of the post under the lip, said base being rigidly fixed to the firearm when the post is rigidly secured in the aperture, whereby the combination of an auxiliary sighting aid and a base that is affixed to the auxiliary sighting aid may be selectively installed and removed from a firearm as a unit by merely securing the post in the aperture.

2. The apparatus as claimed in claim 1 wherein the means for selectively securing the post in the aperture includes a generally circular knob that is rotated in a plane that is generally perpendicular to the longitudinal axis of the post and without the need for any tools, whereby the auxiliary sighting aid may be selectively installed and removed from the firearm without the need for any tools.

3. The apparatus as claimed in claim 1 wherein the structural part of the firearm having the aperture therein constitutes an integral and permanent portion of the firearm's structure at the time that the firearm is originally manufactured, whereby the apparatus may be utilized without the need for any alteration of the firearm by a gunsmith-by virtue of permitting a user to take advantage of an existing aperture in the firearm's structure.

4. The apparatus as claimed in claim 1 wherein the structural part having the aperture therein is an add-on adaptor which is configured so that it may be rigidly attached to a conventional firearm in order to constitute a structural extension of the firearm's original structure.

5. The apparatus as claimed in claim 1 wherein the post is made of steel and is cylindrical and has a diameter of about 5/16 inch and protrudes longitudinally outward from the base for about 5/16 inch, and wherein the slot extends transversely inward for no more than one-half of the post's diameter, whereby the post can be connected to the structural part by moving the post sideways by a distance of less than the diameter of the post.

6. The apparatus as claimed in claim 1 wherein the distal end of the post has a hook-shaped appearance when examined in a side elevational view, said hook-shaped end of the post being defined by a longitudinal section and a transverse section, and the transverse section constituting that portion of the post below the transverse slot when the post is upright and oriented vertically, and wherein said means for selectively and rigidly securing the post in the aperture includes means for retracting the post until it makes firm contact with the lip around the aperture after the transverse section of the post has been positioned at least partially below the lip, whereby the base may be firmly secured to said firearm by inserting the post into the aperture and positioning the transverse section so that it will bear tightly against the lip surrounding the aperture as the post is retracted.

7. The apparatus as claimed in claim 6 wherein the transverse section of the hook-shaped part of the post extends forwardly from the longitudinal section of the post for a distance of about ⅛ inch, whereby the potential engagement area between the transverse section of the post and the lip surrounding the aperture is about ⅛ inch long.

8. The apparatus as claimed in claim 6 wherein said means for retracting the post toward the base includes a generally cylindrical and short knob whose diameter is relatively large in comparison with the diameter of the post, and the knob having internal threads that mate with external threads on the post, said knob being sized and positioned near the top of the base so as to be susceptible to manipulation by the fingers on a single one of a person's hands.

9. The apparatus as claimed in claim 6 and further including a blocking element that is positioned alongside the distal region of the post, the blocking element having a length such that it will protrude into the firearm's aperture far enough to be approximately coextensive with the longitudinal section of the hook-shaped end of the post, and the size of the blocking element being sufficient to preclude removal of the distal end of the post from the aperture even when the transverse element is not tightly pressed against the lip surrounding the aperture.

10. The apparatus as claimed in claim 9 and further including means for selectively retracting said blocking element so that the base may be deliberately withdrawn from the firearm when desired, whereby the base can be precluded from falling away from the firearm and becoming lost even if the post should ever become loosened so that it no longer bears tightly against the lip surrounding the aperture.

11. The apparatus as claimed in claim 10 wherein the blocking element is retractable by touching said blocking element and manually applying a force thereto in a direction toward the base.

12. The apparatus as claimed in claim 9 wherein the blocking element is biased to a downward position alongside the distal end of the post by a resilient element located adjacent the post.

13. The apparatus as claimed in claim 12 wherein the resilient element constitutes a coil spring mounted internally of the post, and said coil spring is sized so as to constantly urge the blocking element to its most downward position when the post is oriented vertically and upright.

14. The apparatus as claimed in claim 9 wherein the post is bifurcated so to provide two legs at its distal end, and wherein the blocking element is made of thin steel and is mounted so as to be longitudinally moveable between the post's two legs.

15. The method of installing an auxiliary sighting aid such as an optical scope on a firearm such as a rifle, shotgun or pistol, wherein the sighting aid is connected to a base having a configuration that fosters a desired alignment of the sighting aid with the bore of the firearm, and the firearm having an aperture in a structural part of the firearm, and the aperture being bounded internally by a structural lip, comprising the steps of:

(a) providing a rigid post that protrudes outwardly from the base for a distance that is sufficient to extend through the firearm's aperture, said post being generally cylindrical and having a generally smooth exterior surface and having no external threads that are exposed where they might be damaged or fouled, and said post also having a transverse recess near its distal end; and (b) connecting the post to the firearm structure by inserting the distal end of the post into the aperture and selectively locking the post in said position by first pushing the post sideward until the recess on the post engages the lip that is around the aperture, and then inserting a blocking member behind the post so that the post cannot be returned to a position that would permit it to be withdrawn from the aperture.

16. The method as claimed in claim 15 wherein the base that has already been connected to the firearm's structure is rigidly secured to that structure by manually manipulating a movable element that causes the post to be retracted until a portion of the post adjacent the recess becomes rigidly pressed against a part of the lip around the aperture, said movable element being a rotatable knob that is located near the top of the base and being threadably connected to the post, such that rotating the knob is effective to raise the post and thereby place the base in compression between the knob and the lip, whereby the base may be rigidly connected to the firearm.

17. The method as claimed in claim 15 wherein the post is locked against withdrawal from the aperture by continuously biasing the blocking element in a downward direction in order that it will enter the aperture and push the post sideward as soon as the post has been lowered to the extent that the transverse recess becomes aligned with the lip, with the result that the post will automatically be positioned so that it will not separate from the aperture even when the post is not bearing tightly against the lip.

18. The method of installing an auxiliary sighting aid such as an optical scope on a firearm such as a rifle, shotgun or pistol, wherein the sighting aid is connected to a base having a configuration that fosters a desired alignment of the sighting aid with the bore of the firearm, and the firearm having an aperture in a structural part of the firearm, and the aperture being bounded internally by a structural lip, comprising the steps of:

(a) providing a rigid post that protrudes outwardly from the base for a distance that is sufficient to extend through the firearm's aperture, said post being generally cylindrical and having a generally smooth exterior surface and having no external threads that are exposed where they might be damaged or fouled, and said post also having a transverse recess near its distal end; and (b) securing the post to the firearm structure by downwardly inserting the distal end of the post into the aperture and selectively locking the post in said position by first pushing the post sideward until a recess on the post engages the lip that is around the aperture, and then rotating a knob that is threadably engaged with the top of the post, and the threaded engagement being operative to withdraw the post upwardly until a surface of the post adjacent the recess bears tightly against the lip as the knob is rotated in a first direction.

19. The method as claimed in claim 18 and including the further step of securing the post in the aperture by positioning a blocking element in the aperture after the post has been inserted therein but before the knob has been rotated to the extent that the post has been brought into tight bearing contact with the lip, and the size of the blocking element being such as to preclude removal of the post for as long as the blocking element is present in the aperture.

20. The method as claimed in claim 19 wherein the blocking element may be retracted in a rapid manner by manually pushing it upward toward the base, and the blocking element may be retracted in a slower manner by drawing it upward through the step of rotating a knob at the top of the base, the knob and the blocking element being slideably connected.

21. The method as claimed in claim 19 and including the further step of continuously biasing the blocking element downward to a position adjacent the aperture where the blocking element can prevent the post from being inadvertently removed from an engaged aperture.

22. The method of selectively attaching an auxiliary sighting aid to firearms including rifles, shotguns and pistols, comprising the steps of:

(a) initially attaching the auxiliary sighting aid to a self-contained mounting device having no separable parts, said mounting device having a protruding post with a longitudinal axis and a diametrical cross-section and a generally smooth exterior surface, and the mounting device having a hook at the distal end of the protruding post, and the transverse cross-section of the hook being small enough to fit within the spatial envelope defined by the diametrical cross-section of the post, whereby the hook may be inserted into any opening that is sized so that it will admit the post; and (b) selectively attaching the protruding post to the firearm with a planned orientation by inserting the post into an aperture on the firearm's structure and engaging the hook with a portion of the firearm's structure in such a way that tension may subsequently be introduced into the hook.

23. The method as claimed in claim 22 wherein tension is achieved in the hook by introducing relative motion between two threaded members, and said threaded members are permanently engaged so that they are removed from the firearm with the auxiliary sighting aid as a unit, and the threaded members are never separated where they might become exposed and hence damaged or fouled, and one of said threaded members is a knob that is shaped like a short cylinder.

* * * * *